US008356487B2

(12) United States Patent
Dendy et al.

(10) Patent No.: US 8,356,487 B2
(45) Date of Patent: Jan. 22, 2013

(54) CONTROL SYSTEM AND METHOD FOR VAPORIZER WITH HEATING TOWER

(75) Inventors: Thomas M. Dendy, Overland Park, KS (US); Peter W. Falcone, Media, PA (US); Glenn S. Brenneke, Lee's Summit, MO (US); Eldon F. Mockry, Lenexa, KS (US)

(73) Assignees: SPX Cooling Technologies, Overland Park, KS (US); Selas Fluid Processing Corporation, Blue Bell, PA (US)

( * ) Notice: Subject to any disclaimer, the term of this patent is extended or adjusted under 35 U.S.C. 154(b) by 1123 days.

(21) Appl. No.: 11/851,831

(22) Filed: Sep. 7, 2007

(65) Prior Publication Data

US 2009/0064688 A1 Mar. 12, 2009

(51) Int. Cl.
*F17C 9/02* (2006.01)

(52) U.S. Cl. ..... 62/50.2; 62/177

(58) Field of Classification Search ..... 62/50.2
See application file for complete search history.

(56) References Cited

U.S. PATENT DOCUMENTS 3,726,101 A * 4/1973 Arenson ..... 62/50.2
4,519,213 A 5/1985 Brigham et al.
5,819,542 A 10/1998 Christiansen et al.
6,076,359 A * 6/2000 Jurcik et al. ..... 62/50.2
6,581,412 B2 * 6/2003 Pant et al. ..... 62/657
6,622,492 B1 * 9/2003 Eyermann ..... 62/50.2
6,644,041 B1 * 11/2003 Eyermann ..... 62/50.2
2005/0081535 A1 4/2005 Engdahl
2006/0242970 A1 11/2006 Yang et al.
2008/0120983 A1 * 5/2008 Eyermann ..... 62/50.2
2009/0065181 A1 * 3/2009 Mockry et al. ..... 165/104.28

OTHER PUBLICATIONS

C.C. Yang and Zupeng Huang, "Lower Emission LNG Vaporization", LNG Journal Nov./Dec. 2004, pp. 24-25.

* cited by examiner

*Primary Examiner* — Allen Flanigan

(74) *Attorney, Agent, or Firm* — Baker & Hostetler LLP

(57) ABSTRACT

A method of vaporizing liquefied natural gas includes passing liquefied natural gas through a submerged combustion vaporizer having a water bath at a bath temperature and a burner to provide a vaporized gas output at a send-out temperature, drawing water from the bath of the submerged combustion vaporizer and supplying it to an atmospheric heating tower having an ambient air temperature, returning water from the atmospheric heating tower to the bath of the submerged combustion vaporizer, modulating the operating rate of the burner of the submerged combustion vaporizer, and modulating the operating rate of the atmospheric heating tower.

20 Claims, 11 Drawing Sheets

FIG. 5A

| WB (°F) | Supply Temp (°F) | Return Temp @ 100% Tower Capacity (°F) | HT - Heat Capability (MMBtu/hr) | HT - Heat Provided (MMBtu/hr) | % of HT Max (%) | SCV - Heat Provided (MMBtu/hr) | SCV - Turn Down Ratio (X:1) | Gas Temp Leaving SCV (°F) | Superheat Required (MMBtu/hr) | Notes | % of HT | % of SCV |
|---|---|---|---|---|---|---|---|---|---|---|---|---|
| 85.0 | 55.0 | 76.0 | 293.8 | 105.0 | 36% | 0.0 | 0.0 | 40.0 | 0.0 | SCV is not supplying heat. Modulate tower fan operation to maintain 55°F supply temperature to tower. | 100% | 0% |
| 84.0 | 55.0 | 75.1 | 280.9 | 105.0 | 37% | 0.0 | 0.0 | 40.0 | 0.0 | | 100% | 0% |
| 83.0 | 55.0 | 74.2 | 268.2 | 105.0 | 39% | 0.0 | 0.0 | 40.0 | 0.0 | | 100% | 0% |
| 82.0 | 55.0 | 73.3 | 255.7 | 105.0 | 41% | 0.0 | 0.0 | 40.0 | 0.0 | | 100% | 0% |
| 81.0 | 55.0 | 72.4 | 243.4 | 105.0 | 43% | 0.0 | 0.0 | 40.0 | 0.0 | | 100% | 0% |
| 80.0 | 55.0 | 71.5 | 231.4 | 105.0 | 45% | 0.0 | 0.0 | 40.0 | 0.0 | | 100% | 0% |
| 79.0 | 55.0 | 70.7 | 219.5 | 105.0 | 48% | 0.0 | 0.0 | 40.0 | 0.0 | | 100% | 0% |
| 78.0 | 55.0 | 69.9 | 207.9 | 105.0 | 50% | 0.0 | 0.0 | 40.0 | 0.0 | | 100% | 0% |
| 77.0 | 55.0 | 69.0 | 196.5 | 105.0 | 53% | 0.0 | 0.0 | 40.0 | 0.0 | | 100% | 0% |
| 76.0 | 55.0 | 68.2 | 185.4 | 105.0 | 57% | 0.0 | 0.0 | 40.0 | 0.0 | | 100% | 0% |
| 75.0 | 55.0 | 67.5 | 174.4 | 105.0 | 60% | 0.0 | 0.0 | 40.0 | 0.0 | | 100% | 0% |
| 74.0 | 55.0 | 66.7 | 163.7 | 105.0 | 64% | 0.0 | 0.0 | 40.0 | 0.0 | | 100% | 0% |
| 73.0 | 55.0 | 65.9 | 153.2 | 105.0 | 69% | 0.0 | 0.0 | 40.0 | 0.0 | | 100% | 0% |
| 72.0 | 55.0 | 65.2 | 142.9 | 105.0 | 73% | 0.0 | 0.0 | 40.0 | 0.0 | | 100% | 0% |
| 71.0 | 55.0 | 64.5 | 132.8 | 105.0 | 79% | 0.0 | 0.0 | 40.0 | 0.0 | | 100% | 0% |
| 70.0 | 55.0 | 63.8 | 123.0 | 105.0 | 85% | 0.0 | 0.0 | 40.0 | 0.0 | | 100% | 0% |
| 69.0 | 55.0 | 63.1 | 113.3 | 105.0 | 93% | 0.0 | 0.0 | 40.0 | 0.0 | | 100% | 0% |
| 68.0 | 55.0 | 62.4 | 103.9 | 81.7 | 79% | 23.3 | 4.5 | 40.0 | 0.0 | SCV operates at minimum turn-down. Modulate tower fan operation to maintain 55°F supply temperature to tower | 78% | 22% |

FIG. 5B

| WB (°F) | Supply Temp (°F) | Return Temp @ 100% Tower Capacity (°F) | HT - Heat Capability (MMBtu/hr) | HT - Heat Provided (MMBtu/hr) | % of HT Max (%) | SCV - Heat Provided (MMBtu/hr) | SCV - Turn Down Ratio (X:1) | Gas Temp Leaving SCV (°F) | Superheat Required (MMBtu/hr) | Notes | % of HT | % of SCV |
|---|---|---|---|---|---|---|---|---|---|---|---|---|
| 67.0 | 55.0 | 61.8 | 94.7 | 81.7 | 86% | 23.3 | 4.5 | 40.0 | 0.0 | | 78% | 22% |
| 66.0 | 55.0 | 61.1 | 85.7 | 81.7 | 95% | 23.3 | 4.5 | 40.0 | 0.0 | | 78% | 22% |
| 65.0 | 55.0 | 60.5 | 77.0 | 77.0 | 100% | 28.0 | 3.7 | 40.0 | 0.0 | SCV operates normally. Heating Tower is fully operational. SCV is modulated to maintain 55°F supply temperature to the tower. | 73% | 27% |
| 64.0 | 55.0 | 59.9 | 68.4 | 68.4 | 100% | 36.6 | 2.9 | 40.0 | 0.0 | | 65% | 35% |
| 63.0 | 55.0 | 59.3 | 60.1 | 60.1 | 100% | 44.9 | 2.3 | 40.0 | 0.0 | | 57% | 43% |
| 62.0 | 55.0 | 58.7 | 52.0 | 52.0 | 100% | 53.0 | 2.0 | 40.0 | 0.0 | | 50% | 50% |
| 61.0 | 55.0 | 58.2 | 44.1 | 44.1 | 100% | 60.9 | 1.7 | 40.0 | 0.0 | | 42% | 58% |
| 60.0 | 55.0 | 57.6 | 36.5 | 36.5 | 100% | 68.5 | 1.5 | 40.0 | 0.0 | | 35% | 65% |
| 59.0 | 55.0 | 57.1 | 29.0 | 29.0 | 100% | 76.0 | 1.4 | 40.0 | 0.0 | | 28% | 72% |
| 58.0 | 55.0 | 56.6 | 21.8 | 21.8 | 100% | 83.2 | 1.3 | 40.0 | 0.0 | | 21% | 79% |
| 57.0 | 55.0 | 58.1 | 14.8 | 14.8 | 100% | 90.2 | 1.2 | 40.0 | 0.0 | | 14% | 86% |
| 56.0 | 55.0 | 55.6 | 8.0 | 8.0 | 100% | 97.0 | 1.1 | 40.0 | 0.0 | | 8% | 92% |
| 55.0 | 55.0 | 55.1 | 1.5 | 1.5 | 100% | 103.5 | 1.0 | 40.0 | 0.0 | | 1% | 99% |
| 54.0 | 55.0 | 54.7 | -4.9 | -4.9 | 100% | 109.9 | 1.0 | 40.0 | 0.0 | Pump for Heating Tower is shut-off to eliminate loss of heat. All heat comes from SCV. | 0% | 100% |

FIG. 6A

| WB (°F) | Supply Temp (°F) | Return Temp @ 100% Tower Capacity (°F) | HT - Heat Capability (MMBtu/hr) | HT - Heat Provided (MMBtu/hr) | % of HT Max (%) | SCV - Heat Provided (MMBtu/hr) | SCV - Turn Down Ratio (X:1) | Gas Temp Leaving SCV (°F) | Superheat Required (MMBtu/hr) | Notes | % of HT | % of SCV |
|---|---|---|---|---|---|---|---|---|---|---|---|---|
| 85.0 | 55.0 | 76.1 | 296.0 | 105.0 | 35% | 0.0 | 0.0 | 40.0 | 0.0 | SCV is not supplying heat Modulate tower fan operation to maintain 55°F supply temperature to tower. | 100% | 0% |
| 84.0 | 55.0 | 75.2 | 282.6 | 105.0 | 37% | 0.0 | 0.0 | 40.0 | 0.000 | | 100% | 0% |
| 83.0 | 55.0 | 74.2 | 269.5 | 105.0 | 39% | 0.0 | 0.0 | 40.0 | 0.000 | | 100% | 0% |
| 82.0 | 55.0 | 73.3 | 256.6 | 105.0 | 41% | 0.0 | 0.0 | 40.0 | 0.000 | | 100% | 0% |
| 81.0 | 55.0 | 72.4 | 244.0 | 105.0 | 43% | 0.0 | 0.0 | 40.0 | 0.000 | | 100% | 0% |
| 80.0 | 55.0 | 71.5 | 231.6 | 105.0 | 45% | 0.0 | 0.0 | 40.0 | 0.000 | | 100% | 0% |
| 79.0 | 55.0 | 70.7 | 219.4 | 105.0 | 48% | 0.0 | 0.0 | 40.0 | 0.000 | | 100% | 0% |
| 78.0 | 55.0 | 69.8 | 207.5 | 105.0 | 51% | 0.0 | 0.0 | 40.0 | 0.000 | | 100% | 0% |
| 77.0 | 55.0 | 69.0 | 195.8 | 105.0 | 54% | 0.0 | 0.0 | 40.0 | 0.000 | | 100% | 0% |
| 76.0 | 55.0 | 68.2 | 184.4 | 105.0 | 57% | 0.0 | 0.0 | 40.0 | 0.000 | | 100% | 0% |
| 75.0 | 55.0 | 67.4 | 173.1 | 105.0 | 61% | 0.0 | 0.0 | 40.0 | 0.000 | | 100% | 0% |
| 74.0 | 55.0 | 66.6 | 162.1 | 105.0 | 65% | 0.0 | 0.0 | 40.0 | 0.000 | | 100% | 0% |
| 73.0 | 55.0 | 65.8 | 151.3 | 105.0 | 69% | 0.0 | 0.0 | 40.0 | 0.000 | | 100% | 0% |
| 72.0 | 55.0 | 65.1 | 140.7 | 105.0 | 75% | 0.0 | 0.0 | 40.0 | 0.000 | | 100% | 0% |
| 71.0 | 55.0 | 64.3 | 130.4 | 105.0 | 81% | 0.0 | 0.0 | 40.0 | 0.000 | | 100% | 0% |
| 70.0 | 55.0 | 63.6 | 120.2 | 105.0 | 87% | 0.0 | 0.0 | 40.0 | 0.000 | | 100% | 0% |
| 69.0 | 55.0 | 62.9 | 110.2 | 105.0 | 95% | 0.0 | 0.0 | 40.0 | 0.000 | | 100% | 0% |
| 68.0 | 54.40 | 61.9 | 105.0 | 105.0 | 100% | 0.0 | 0.0 | 39.4 | 0.156 | Tower operates at 100% capability. Superheater starts to maintain gas send out of 40°F | 100% | 0% |

FIG. 6B

| WB (°F) | Supply Temp (°F) | Return Temp @ 100% Tower Capacity (°F) | HT - Heat Capability (MMBtu/hr) | HT - Heat Provided (MMBtu/hr) | % of HT Max (%) | SCV - Heat Provided (MMBtu/hr) | SCV - Turn Down Ratio (X:1) | Gas Temp Leaving SCV (°F) | Superheat Required (MMBtu/hr) | Notes | % of HT | % of SCV |
|---|---|---|---|---|---|---|---|---|---|---|---|---|
| 67.0 | 53.12 | 60.6 | 105.0 | 105.0 | 100% | 0.0 | 0.0 | 38.1 | 0.488 | | 100% | 0% |
| 66.0 | 51.82 | 59.3 | 105.0 | 105.0 | 100% | 0.0 | 0.0 | 36.8 | 0.826 | | 100% | 0% |
| 65.0 | 50.52 | 58.0 | 105.0 | 105.0 | 100% | 0.0 | 0.0 | 35.5 | 1.163 | | 100% | 0% |
| 64.0 | 49.22 | 56.7 | 105.0 | 105.0 | 100% | 0.0 | 0.0 | 34.2 | 1.501 | | 100% | 0% |
| 63.0 | 47.92 | 55.4 | 105.0 | 105.0 | 100% | 0.0 | 0.0 | 32.9 | 1.839 | | 100% | 0% |
| 62.0 | 46.63 | 54.1 | 105.0 | 105.0 | 100% | 0.0 | 0.0 | 31.6 | 2.174 | | 100% | 0% |
| 61.0 | 45.35 | 52.8 | 105.0 | 105.0 | 100% | 0.0 | 0.0 | 30.4 | 2.506 | | 100% | 0% |
| 60.0 | 44.07 | 51.6 | 105.0 | 105.0 | 100% | 0.0 | 0.0 | 29.1 | 2.839 | | 100% | 0% |
| 59.0 | 42.83 | 50.3 | 105.0 | 105.0 | 100% | 0.0 | 0.0 | 27.8 | 3.161 | | 100% | 0% |
| 58.0 | 41.61 | 49.1 | 105.0 | 105.0 | 100% | 0.0 | 0.0 | 26.6 | 3.477 | | 100% | 0% |
| 57.0 | 40.42 | 47.9 | 105.0 | 105.0 | 100% | 0.0 | 0.0 | 25.4 | 3.786 | | 100% | 0% |
| 56.0 | 39.26 | 46.8 | 105.0 | 105.0 | 100% | 0.0 | 0.0 | 24.3 | 4.088 | | 100% | 0% |
| 55.0 | 38.14 | 45.6 | 105.0 | 105.0 | 100% | 0.0 | 0.0 | 23.1 | 4.379 | | 100% | 0% |
| 54.0 | 37.06 | 44.6 | 105.0 | 105.0 | 100% | 0.0 | 0.0 | 22.1 | 4.659 | | 100% | 0% |
| 53.0 | 36.02 | 43.5 | 105.0 | 105.0 | 100% | 0.0 | 0.0 | 21.0 | 4.929 | | 100% | 0% |
| 52.0 | 35.02 | 42.5 | 105.0 | 105.0 | 100% | 0.0 | 0.0 | 20.0 | 5.189 | | 100% | 0% |
| 51.0 | 35.00 | 42.0 | 97.7 | 76.7 | 78% | 23.3 | 4.3 | 20.0 | 5.194 | SCV operates at minimum turn-down. Modulate tower fan operation to maintain 35°F supply temperature to tower | 73% | 22% |
| 50.0 | 35.00 | 41.4 | 90.3 | 76.7 | 85% | 23.3 | 4.3 | 20.0 | 5.194 | | 73% | 22% |
| 49.0 | 35.00 | 40.9 | 82.9 | 76.7 | 93% | 23.3 | 4.3 | 20.0 | 5.194 | | 73% | 22% |
| 48.0 | 35.00 | 40.4 | 75.5 | 75.5 | 100% | 24.5 | 4.1 | 20.0 | 5.194 | SCV operates normally. Heating tower operations at 100% capability. SCV is modulated to maintain 35°F supply temperature to the tower. Superheater is fully operational. | 72% | 23% |

FIG. 6C

| WB (°F) | Supply Temp (°F) | Return Temp @ 100% Tower Capacity (°F) | HT - Heat Capability (MMBtu/hr) | HT - Heat Provided (MMBtu/hr) | % of HT Max (%) | SCV - Heat Provided (MMBtu/hr) | SCV - Turn Down Ratio (X:1) | Gas Temp Leaving SCV (°F) | Superheat Required (MMBtu/hr) | Notes | % of HT | % of SCV |
|---|---|---|---|---|---|---|---|---|---|---|---|---|
| 47.0 | 35.00 | 39.9 | 68.1 | 68.1 | 100% | 31.9 | 3.1 | 20.0 | 5.194 | | 65% | 30% |
| 46.0 | 35.00 | 39.3 | 60.8 | 60.8 | 100% | 39.2 | 2.5 | 20.0 | 5.194 | | 58% | 37% |
| 45.0 | 35.00 | 38.8 | 53.4 | 53.4 | 100% | 46.6 | 2.1 | 20.0 | 5.194 | | 51% | 44% |
| 44.0 | 35.00 | 38.3 | 46.0 | 46.0 | 100% | 54.0 | 1.9 | 20.0 | 5.194 | | 44% | 51% |
| 43.0 | 35.00 | 37.7 | 38.5 | 38.5 | 100% | 61.5 | 1.6 | 20.0 | 5.194 | | 37% | 59% |
| 42.0 | 35.00 | 37.2 | 30.9 | 30.9 | 100% | 69.1 | 1.4 | 20.0 | 5.194 | | 29% | 66% |
| 41.0 | 35.00 | 36.7 | 23.3 | 23.3 | 100% | 76.7 | 1.3 | 20.0 | 5.194 | | 22% | 73% |
| 40.0 | 35.00 | 36.1 | 15.5 | 15.5 | 100% | 84.5 | 1.2 | 20.0 | 5.194 | | 15% | 80% |
| 39.0 | 35.00 | 35.5 | 7.5 | 7.5 | 100% | 92.5 | 1.1 | 20.0 | 5.194 | | 7% | 88% |
| 38.0 | 35.00 | 35.0 | -0.6 | -0.6 | 100% | 100.6 | 1.0 | 20.0 | 5.194 | Pump for Heating Tower is shut-off to eliminate loss of heat. All heat comes from SCV. SCV raises bath temperature to 55°F | 0% | 96% |

CONTROL SYSTEM AND METHOD FOR VAPORIZER WITH HEATING TOWER

FIELD OF THE INVENTION

The invention pertains generally to the field of heat exchanger control. More particularly, the invention relates to a system and method for control of a vaporizer, such as a submerged combustion vaporizer for LNG vaporization, in combination with an atmospheric heating tower.

BACKGROUND OF THE INVENTION

Heat exchangers are in wide use in industry. One application for heat exchangers is the vaporization of liquefied natural gas (LNG). Systems are known for adding heat to liquefied natural gas to convert it to a gas state. One type of LNG evaporator is a so-called submerged combustion vaporizer (SCV). An SCV generally has a water bath tank in which is submerged a vaporization coil. Liquefied LNG is supplied to the vaporization coil from outside the SCV, runs through the coil and is evaporated inside the coil, and exits the SCV as a gas. To accomplish this, heat needs to be continually added to the water bath.

One way the heat can be added is that the SCV contains a partially submerged fan-driven combustion device having a specially designed burner which will produce hot flue gases that are conveyed via distributor ductwork and sparger assemblies into the water bath below the LNG vaporization coil. The sparger assemblies direct heat into the water bath both by surface convection on the outside metal walls and conductive heat transfer via direct contact of hot flue gases with surrounding water. Thus, heat transferred to the water bath is subsequently transferred to the outside metal wall surface of the LNG vaporization coil submerged with the water bath.

Some SCVs have an adjustable operating range of heat addition. That is, there will be a 100% design operating condition, whereby the fan and/or fuel gas burn rate can be reduced continuously to a lower level as necessary to match the heat input requirements to produce/maintain the desired LNG vaporization rate. However, there is a lower limit to which the SCV output may be reduced without reaching mechanical/process constraints with the equipment. That is, it is difficult to operate a SCV below a certain minimum level because turndown capability is fixed by factors such as fan performance characteristics and flame stability under various air/fuel ratios. This turndown capability characteristic of SCVs is discussed in more detail below.

Another method for adding heat to a water bath is the use of an atmospheric heating tower. Atmospheric cooling towers are well known, and it has been found that where it is desired to heat a fluid, rather than cool it, so long as the atmospheric temperature is greater than the supply temperature to the tower, it is possible to use atmospheric towers that are configured generally like cooling towers but operated in a fashion so that they will actually heat the water supplied to the tower and provide an output warmer than the input.

Operation of SCV, and operation of heating towers, often occur in areas where the ambient temperature will change both during the course of the day and evening, and also seasonally. It would be desirable to have a system and method that could control an SCV and/or heating tower in such a way as to provide the efficient and effective vaporization of LNG.

SUMMARY OF THE INVENTION

One embodiment of the invention provides a method of vaporizing liquefied natural gas consists of passing liquefied natural gas through a submerged combustion vaporizer having a water bath at a bath temperature and a burner to provide a vaporized gas output at a send-out temperature, drawing water from the bath of the submerged combustion vaporizer and supplying it to an atmospheric heating tower having an ambient air temperature, returning water from the atmospheric heating tower to the bath of the submerged combustion vaporizer, modulating the operating rate of the burner of the submerged combustion vaporizer, and modulating the operating rate of the atmospheric heating tower.

Another embodiment of the present invention comprises means for passing liquefied natural gas through a submerged combustion vaporizer having a water bath at a bath temperature and a burner to provide a vaporized gas output at a send-out temperature, means for drawing water from the bath of the submerged combustion vaporizer and supplying it to an atmospheric heating tower having an ambient air temperature, means for returning water from the atmospheric heating tower to the bath of the submerged combustion vaporizer, means for modulating the operating rate of the burner of the submerged combustion vaporizer, and means for modulating the operating rate of the atmospheric heating tower.

Another embodiment for vaporizing liquefied natural gas includes a submerged combustion vaporizer having a water bath of a bath temperature and a burner, to provide a vaporized gas output at a send-out temperature, an atmospheric heating tower having an ambient air temperature, a circuit that draws water from the bath of the submerged combustion vaporizer and supplies it to the atmospheric heating tower and returns the water from the atmospheric heating tower to the bath of the submerged combustion vaporizer, and a controller that modulates the operating rate of the burner of the submerged combustion vaporizer, and the operating rate of the atmospheric heating tower.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIGS. 5A and 5B form a table depicting operating conditions of a heating tower used with an SCV where the SCV does not have a superheat feature.

FIGS. 6A, 6B and 6C form a table depicting operating conditions of a heating tower used with an SCV where the SCV has a superheat feature.

DETAILED DESCRIPTION

Figure 1:
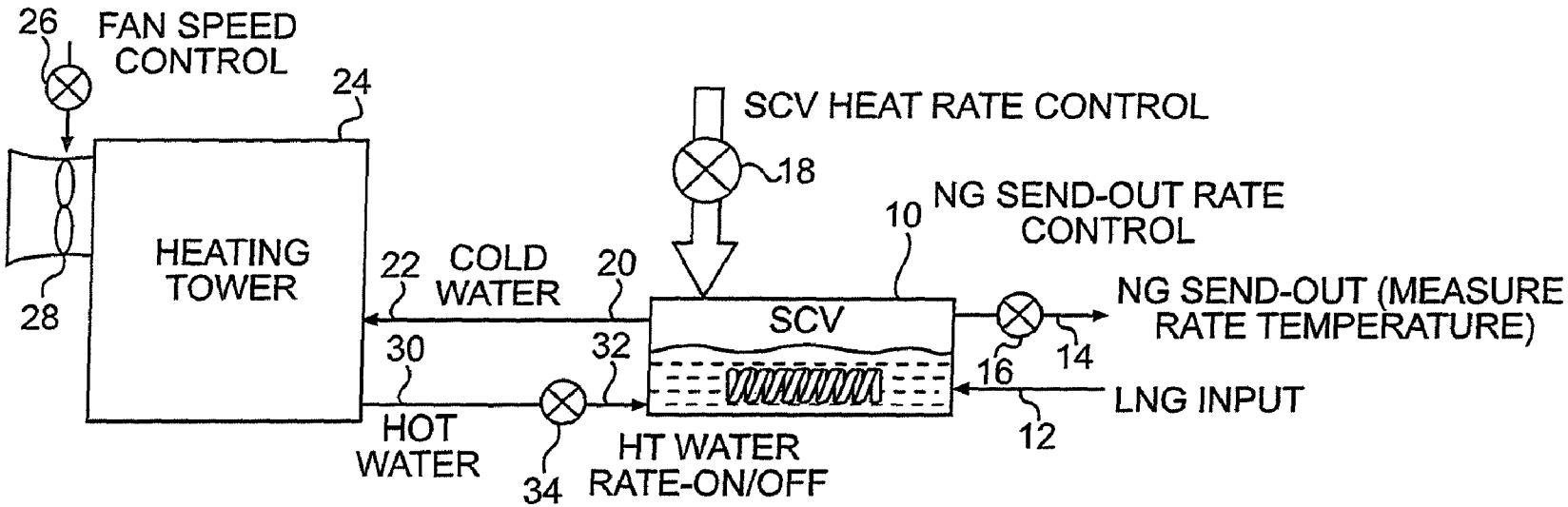
FIG. 1 is a schematic representation of a control arrangement for an SCV used in conjunction with an atmospheric heating tower.

FIG. 1 is a schematic depiction of a system for the vaporization of liquefied natural gas (LNG), including a control arrangement. A submerged combustion vaporizer (SCV) 10 is connected to an input of liquefied natural gas 12 and has an output line 14 at which natural gas is sent out. The gas send out is controlled at a control point 16 at which the gas rate and temperature can be measured and the rate can be controlled. The submerged combustion vaporizer 10 includes an internal vaporization coil in a water bath, and otherwise can be a typical submerged combustion vaporizer. It will therefore typically have a combustion chamber that produces hot flue gases as well as a flue gas output in the water bath inside the SCV. The water bath also surrounds the vaporization coil. The SCV may be optionally provided with a superheat device that further directly heats the gas after it leaves the submerged vaporization coil. The heat rate provided by the SCV is controlled by a SCV heat rate control device 18, which controls the heat air for and/or the fuel burner by the SCV burner.

The SCV has a cold water output line 20 which feeds to a heating tower input line 22. A heating tower 24 is provided as an atmospheric heating tower where the cold water falls through the tower and is heated by interaction with warmer ambient air. The operation of the heating tower 24 can be controlled by a fan speed control 26 which controls a fan 28 to modulate the air flow rate through the tower. The cold water, after being warmed in the heating tower, is collected in a basin of the heating tower and exits the heating tower via a hot water outlet conduit 30 which leads to a hot water inlet conduit 32 which is supplied into the SCV water bath. The flow rate of the heating tower hot water to the SCV is controlled by an on/off valve 34.

It will be appreciated that the system can be operated in several modes. For example, the system can be operated in a mode where only the SCV 10 is turned on, and the SCV 10 provides all of the heat needed for vaporization of the gas, and the tower fans are turned off and water is not recirculated through the tower.

In another mode, the SCV can be turned off (that is, has its burner turned off), and the circulation of water through the heating tower can be used to supply all the heat to the SCV bath water for vaporization of the LNG.

In yet another mode, both the SCV and heating tower can be operated at the same time. Also, both the SCV and the heating tower are typically operable through a continuous range. Thus, it is possible to operate the SCV fully, while operating the heating tower partially, or to operate the heating tower fully while operating the SCV partially, or to operate both devices at a partial rate.

The SCV consumes energy and cost due to the fuel (typically natural gas) used in the SCV combustion as well as a fan that is usually associated with the SCV to force the air through the burner and out the flue gas (sparger pipe) outlet. The heating tower also consumes power by virtue of one or more fans and water pumps to circulate the water to and from the tower. In general, however, the heating tower fan electricity consumption in many conditions will be significantly lower per energy unit added than the fuel cost that is required by the SCV. Of course, this will depend upon the ambient temperature, as well as the relative cost of gas and electricity.

The following discussion will refer to several terms which can be generally explained as follows. The atmospheric temperature at the heating tower will generally be described as a wet bulb temperature, which is a term well known in the art, and is essentially a function of dry bulb temperature and relative humidity. The amount of heat that a heating tower can add to a system is a function of the entering wet bulb temperature to the tower. The temperature varies throughout the day, typically, and also often varies seasonally throughout the year. This causes the immediate heat rate addition capability of a heating tower to vary also.

An SCV is also described herein as having a gas send-out temperature, which is the temperature of the natural gas vapor that exits the vaporizer in the SCV. A supplier of natural gas vapor is typically required to provide the gas at a certain minimum temperature which may typically, for example, be 40° F. Minimum send-out temperatures are generally specified to avoid concern over freezing of ground in which gas pipes may exist or other cold damage to the piping.

SCVs also typically have a maximum turndown ratio. That is, when an SCV burner is dialed down to operate at a fraction of its maximum output, at some point the fuel gas concentration in combustion air will become too dilute to remain within the lower flammability limit. When this limit has been reached, the flame will be extinguished. However, prior to this point the flame will transition into an unstable zone with increased emissions of carbon monoxide and unburned hydrocarbons. A typical turndown ratio limit of 4.5:1 is used in the examples in this application, which means that the SCV burner exhibits a lowest operable setting that is 22% of its maximum setting.

There will also typically be a specified gas send-out rate, which is the amount of vaporized gas exiting the vaporizer. This is generally governed by the pipeline company or gas purchaser itself, which will demand a certain supply rate at any given time.

Referring back to FIG. 1, it will be appreciated that the actual control inputs to the system are the gas send-out rate control 16, the SCV heat rate control 18, the heating tower fan speed control 26, and the heating tower water on/off control 34.

These controls can be modulated by measuring and performing feedback on the measured gas send-out temperature. However, because the wet bulb temperature does affect the amount of heat that is available from the heating tower source, control can sometimes be performed more efficiently and easily by measuring the ambient wet bulb temperature in conjunction with calculations based on a mathematical model of a given heating tower's heat addition performance of that wet bulb temperature.

When the ambient air wet bulb temperature to the tower is high, all of the heat required by an SCV can sometimes be added by the heating tower alone. The gas send-out temperature can be modulated by modulating the fan speed or the fan on/off of the heating tower, while the SCV is turned off and provides no additional heat. The send-out temperature can be measured and the fan speed simply controlled in the feedback loop.

When the wet bulb temperature drops to a point where the heating tower is not maintaining a high enough gas send-out temperature, then supplemental heat from the SCV is added. If all of the heating tower fans are on and the gas send-out temperature is lower than the requirement, the SCV heater is fired or turned on. At this point, the minimum heat added by the SCV as set by the turn down ratio of the SCV burner will be added. Since this may be slightly more than desired, the heating tower might be turned down slightly, or as discussed more below, this transition phrase can simply be operated through.

If the gas send-out temperature still remains too low with the burner operating at a minimum setting, then more heat is required from the SCV. The SCV heat rate can be increased by turning up the burner to maintain the gas send-out temperature at or above the required level.

As the wet bulb temperature continues to decline, at some point the ability of the heating tower to add heat reduces to a point where it becomes uneconomical to run the tower fan to generate such a small or non-existent heat supply from the heating tower. When the ambient wet bulb temperature is equal to or lower than the desired hot water return temperature, the heating tower fans and pumps are shut off.

In the flow diagrams discussed below, certain terms are used which are explained below. The term "RH" refers to relative humidity of the ambient air. The term "DB" refers to dry bulb temperature of the ambient air. The term "baro" refers to barometric pressure of the ambient air. The term "WB" refers to wet bulb temperature of the ambient air. The term "HW" refers to the return temperature of the hot water that is supplied from the basin of the heating tower. The term "SCV" refers to a submerged combustion vaporizer. The term "SCV turn down rate" refers to the lowest output capacity level permitted for operation of the SCV, and is provided as a ratio of the lowest output compared to the maximum output of the SCV. The term "minimum bath temperature" is a selected minimum temperature that is used in the system.

In applications where the SCV has a superheater, superheat can be used to increase the gas send-out temperature for a certain minimum SCV bath temperature, so that in systems with superheat, a lower minimum bath temperature might be practical than would be the case without superheat.

Figure 7:
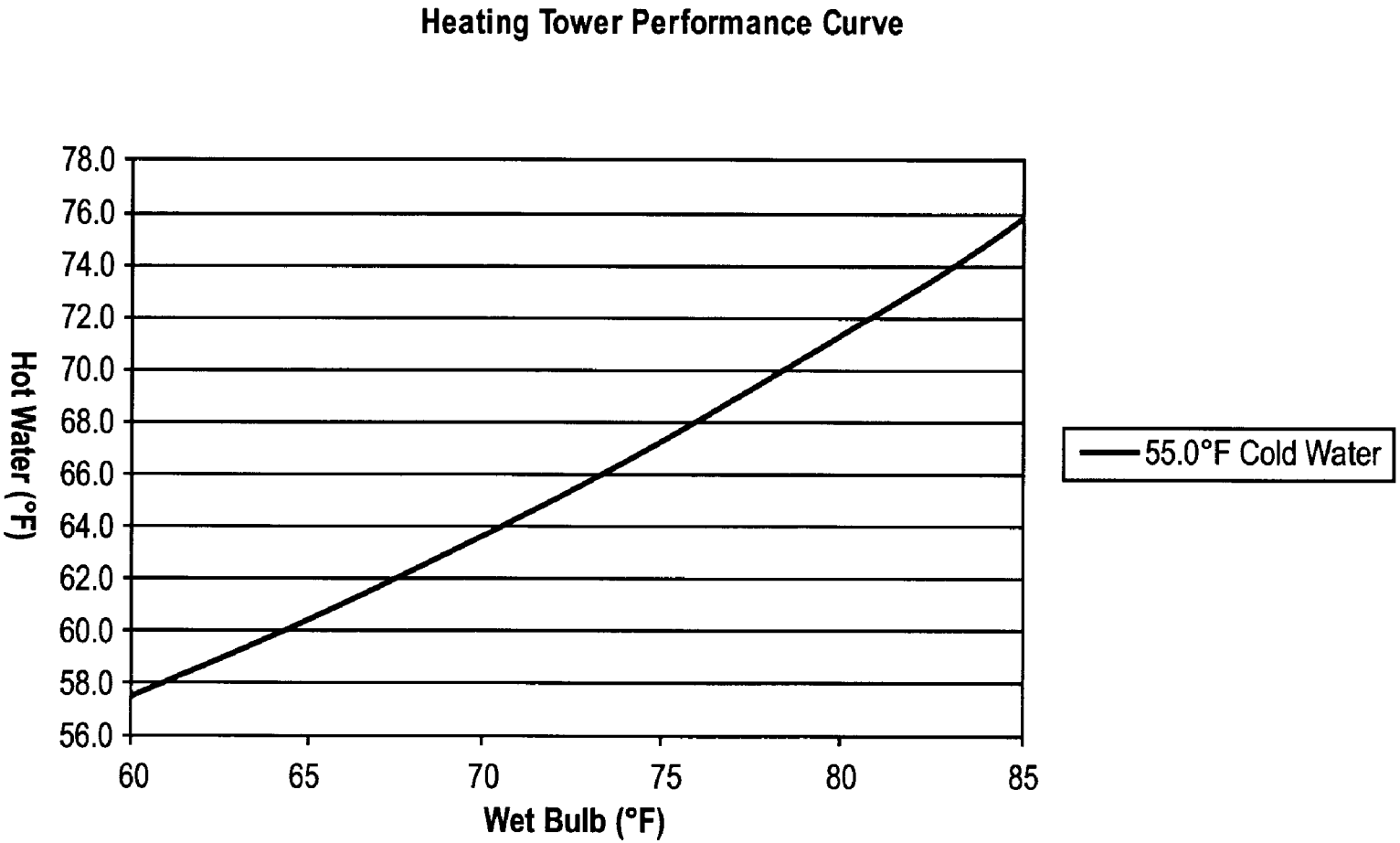
FIG. 7 is a graph depicting a performance curve for a heating tower.
Figure 8:
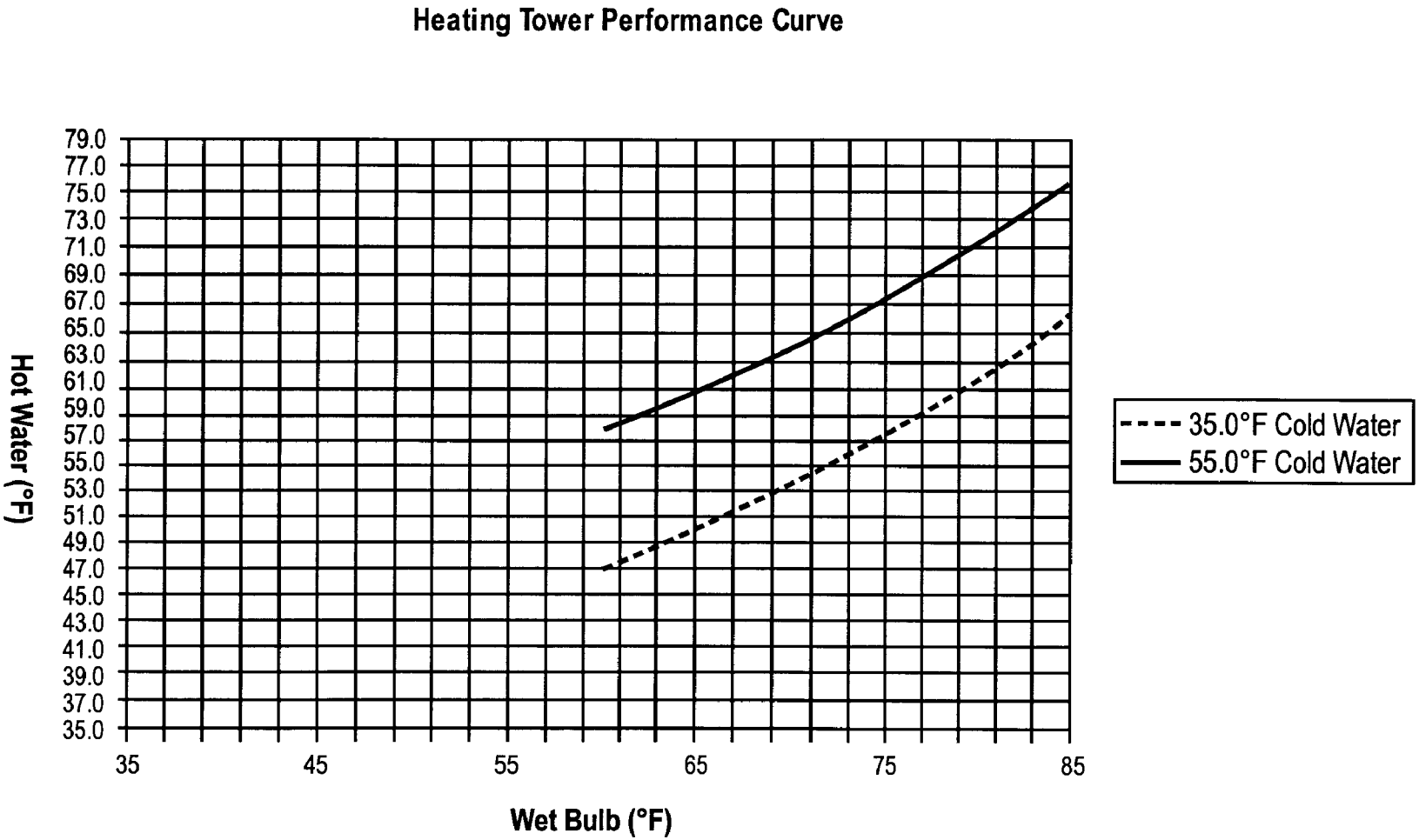
FIG. 8 is a graph depicting a performance curve for a heating tower.

The reference to heating tower models refers to a mathematical performance model determined by expectation or by computer simulation for a given heating tower. Examples are shown in FIGS. 7 and 8. Such a model provides the expected hot water return output temperature from the tower as a function of wet bulb temperature, water flow rate, fan horsepower input, and water supply temperature. These models are generally formulated by heating tower manufacturers for a given tower.

In the examples given below, a system having a single SCV and a single heating tower is used for explanatory purposes. However, it will be appreciated that the control systems and methods described herein can also be applied to arrangements having multiple heating towers and/or multiple SCVs. In particular, in the case of multiple SCVs, it is possible to make the minimum turn down rate be lower for the combined multiple SCVs than it typically is for a single SCV, because it would be possible to run only one or some of the SCVs rather than all of them at the minimum rate.

Figure 2:
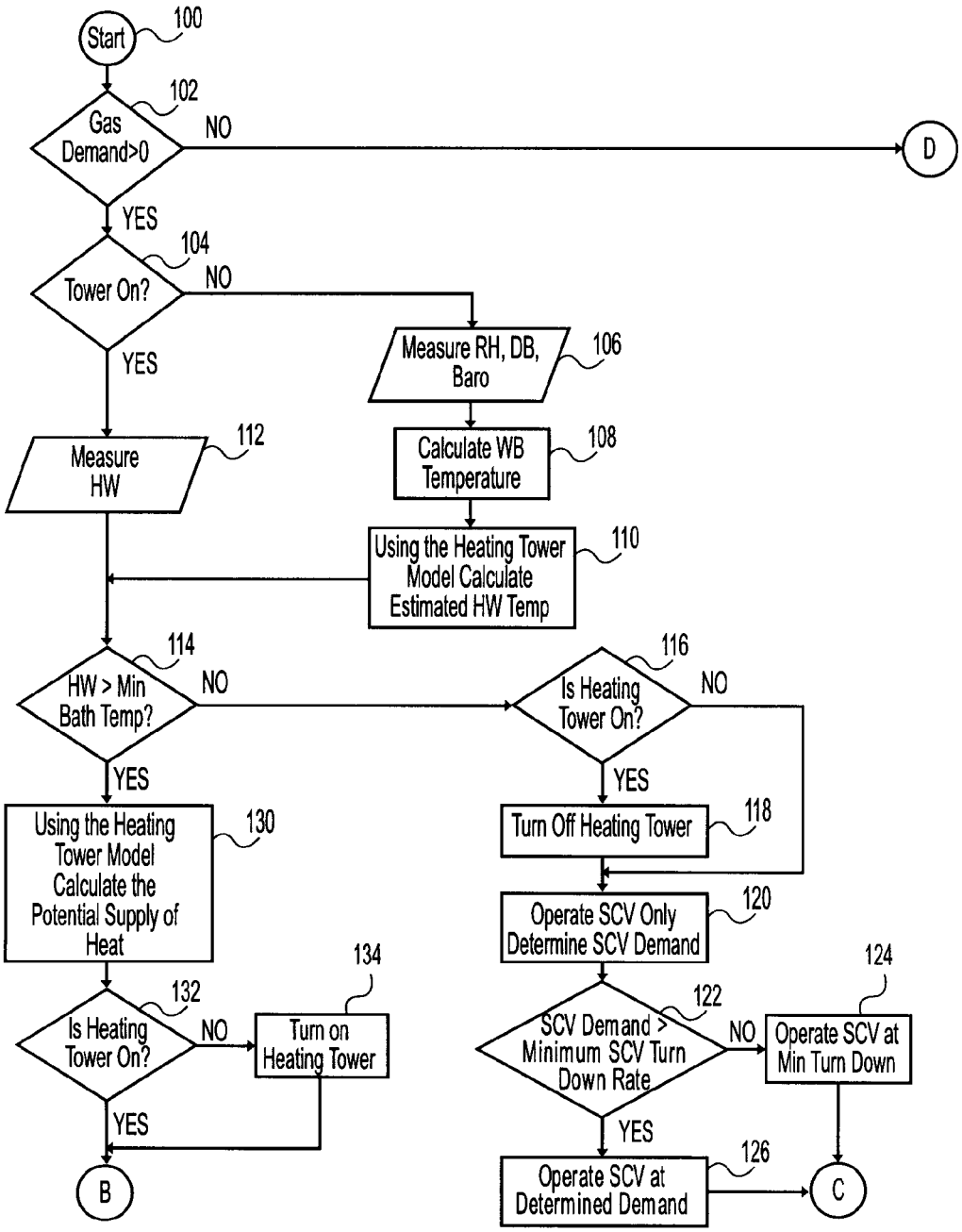
FIG. 2 is a partial flow diagram illustrating control steps for an atmospheric heating tower used with an SCV.
Figure 3:
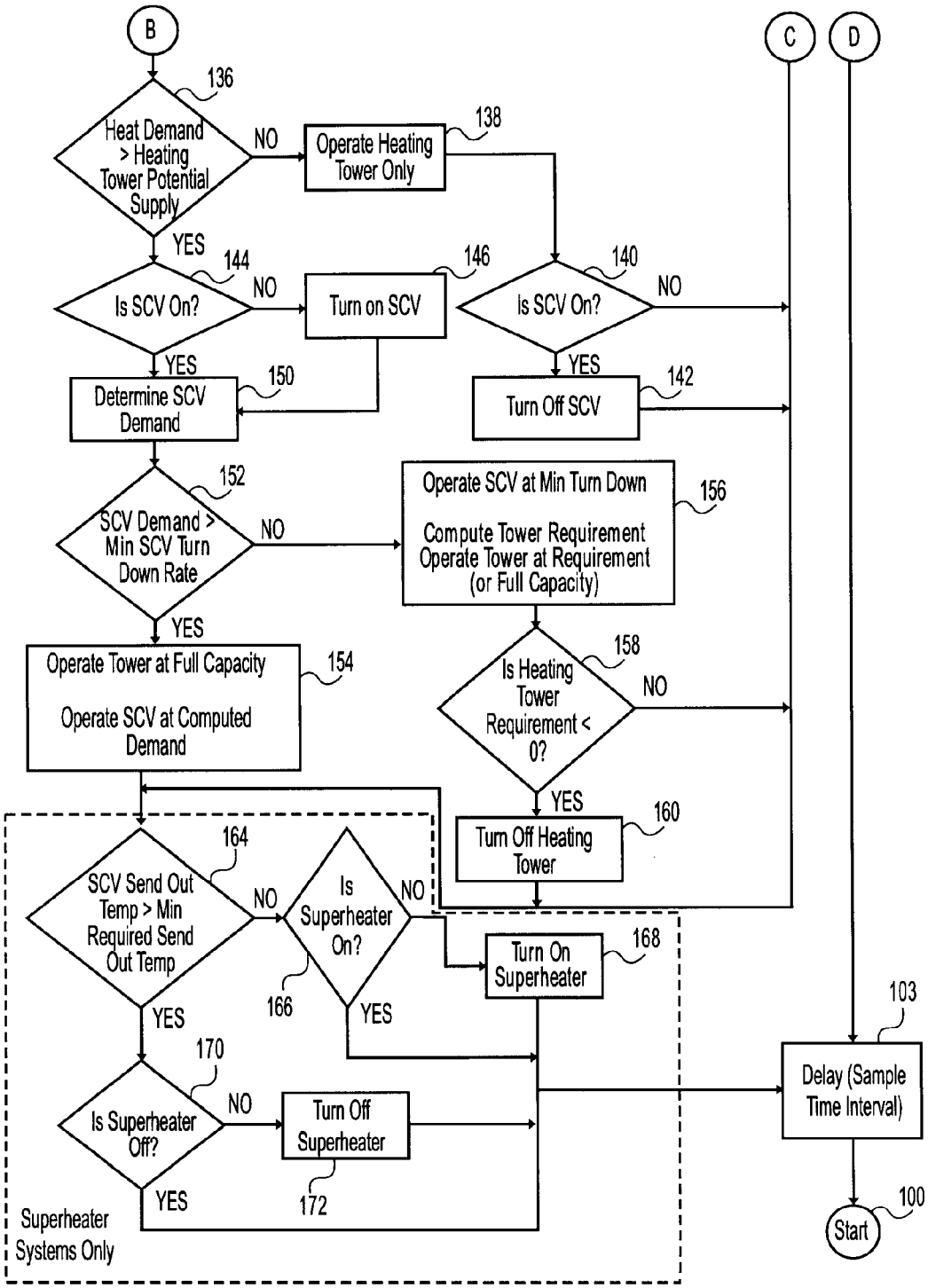
FIG. 3 is a partial flow diagram (continuation from FIG. 2) illustrating control steps for an atmospheric heating tower used with an SCV.

Referring now to FIGS. 2 and 3, a control flow diagram is provided. Beginning at a starting condition 100, the system will determine whether there is any send-out gas demand at step 102. If not, the control will return to an end state for delay 103 at which it will delay by a set time interval and then return to the start position 100.

If there is a demand for vaporized gas at step 102, the controller will perform step 104, which is to check if the tower is on. If the tower is not on, the system will measure the relative humidity, dry bulb temperature, and barometric pressure at step 106 and calculate a wet bulb temperature at step 108. Of course, if an appropriate sensor is available that can simply sense the wet bulb temperature, then there is no need to perform the measurements and calculations, but in any event the system continues its operation based on a calculated or measured wet bulb temperature.

Next at step 110, the system refers to the heating tower model for the heating tower that is being used and calculates an estimated hot water return temperature that is available from the heating tower based on the assumption of a certain cold water supply temperature from the SCV, which is a pre-set selected value (also referred to below as minimum defined bath temperature, or simply bath temperature).

If the tower is determined to be on at step 104, then at step 112 the system measures the hot water return temperature from the heating tower. Next, using a measured or calculated estimated hot water output temperature from the heating tower, at step 114 the system compares the hot tower output temperature to the minimum desired bath temperature in the SCV. If the actual calculated hot water temperature from the tower is not greater than the minimum bath temperature, the system checks whether the heating tower is on at step 116, and if it is, turns off the heating tower at step 118.

At step 120 the system will operate the SCV only based on determined SCV heat demand. If the SCV heat demand is not greater than the SCV minimum turn down rate at step 122, then the SCV is operated at step 124 at its minimum turn down. If the SCV demand is greater than the SCV turn down rate at step 122, then at step 126 the SCV is operated at a computed partial or full SCV demand rate.

Returning to step 114, if the calculated or actual hot water output from the tower is greater than the minimum bath temperature for the SCV, then the system uses the heating tower model to calculate a potential supply of heat from the tower at step 130, checks if the heating tower is on at step 132, and turns it on, if necessary, at step 134. Then, it is checked whether the heat demand at the SCV is greater than the heating tower potential supply at step 136. If it is not, then at step 138 it is possible to operate the heating tower only, check if the SCV is on at step 140 and, if it is, turn off the SCV at step 142. If the heat demand is greater than the potential heat that can be supplied from the heating tower, then at step 144 it is checked whether the SCV is on, and if it is not, is turned on a step 146.

The system then determines at step 150 the SCV demand which is required in addition to the heat that is being supplied by the heating tower, and if the SCV demand is greater than the SCV turn down rate at step 152, the tower will be operated at full capacity and the SCV operated at a computed percentage of its maximum power in order to maintain the bath temperature at the desired bath temperature at step 154. If the SCV demand is not greater than the SCV turndown rate, then the SCV is operated at minimum turndown and the tower operating requirement is determined at step 156. If at step 158 the heating tower requirement is zero or less, the heating tower is turned off at step 160.

After step 154, 158 or 160, the system returns to the delay point 103 and then returns to the start 100, unless there is a superheater system. If there is a superheater system, then after step 154, 158 or 160, the system enters the steps in the dotted box. At step 164 it is determined whether the SCV send-out temperature is greater than a minimum required send-out temperature. If not, at step 166 a check is made to determine if the superheater is turned on. If the superheater is off, step 168 turns the superheater on. If at step 164 the SCV send-out temperature is greater than a minimum required send-out temperature, it is checked at step 170 whether the superheater is off, and if not, the superheater is turned off at step 172. After steps 166, 168, 170, or 172 the control returns to the delay point 103 and the start 100.

Figure 4:
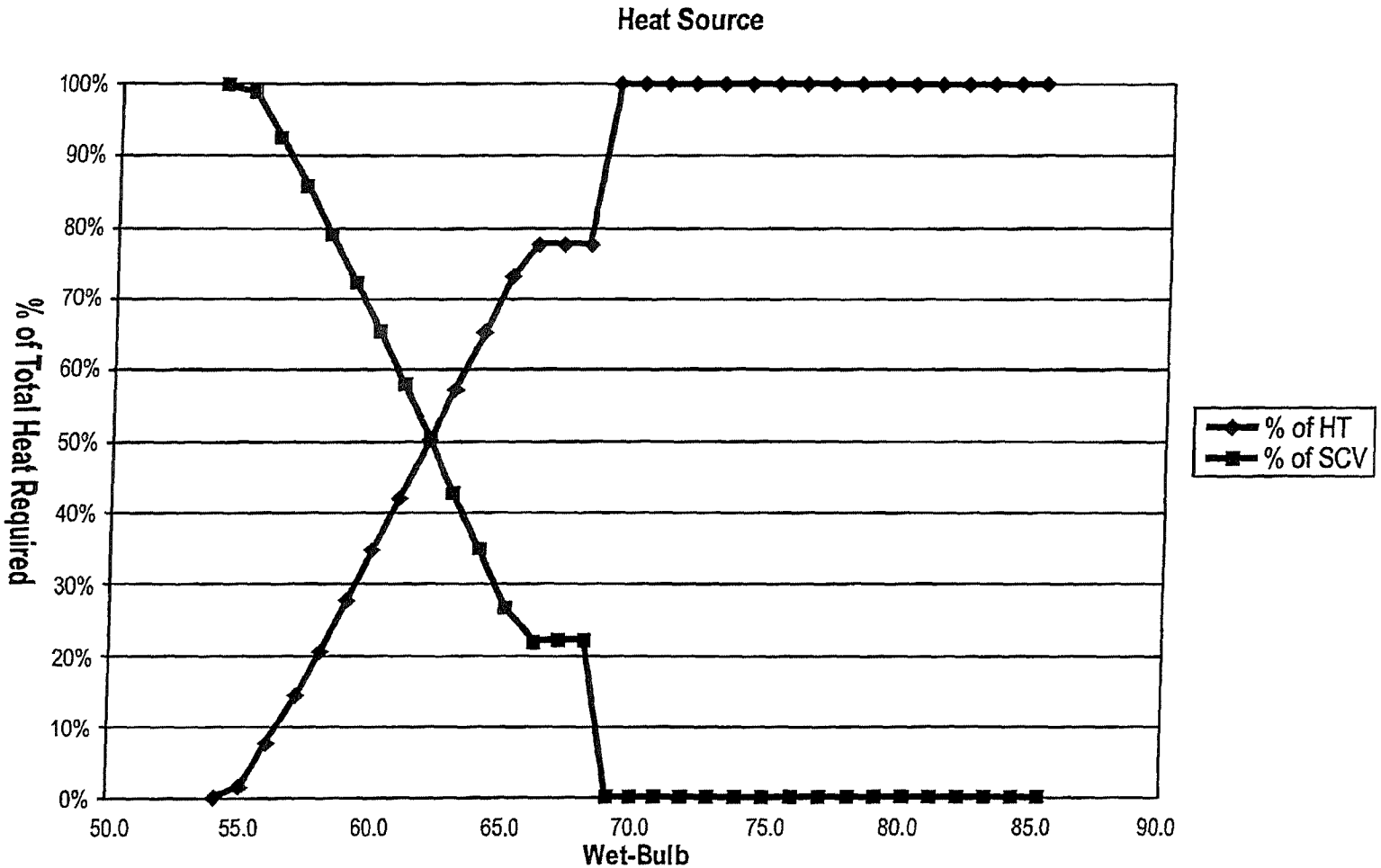
FIG. 4 is a graph depicting an example of percentage utilization of a heating tower and an SCV over a range of ambient temperatures.

FIG. 4 is a graph depicting the percentage of heat that is added to the SCV bath in a given example over a range of temperatures. In this example, the desired SCV bath temperature is 55°. Accordingly, if the ambient wet bulb temperature is below 55°, then all of the heat is added by the SCV. As the temperature moves in this example from 55° to a little over 65°, the heating tower is adding an increasing percentage and the SCV is adding a decreasing percentage. A relatively flat intermediate portion of the SCV line is the transition state where the SCV is being operated at its minimum turndown rate. During this transition state, in theory it is desirable to modulate the heating tower to accommodate the extra heat being added by the SCV. At a little under 70° in this example, the heating tower is able to add 100% of the necessary heat, and the SCV has been turned off and is adding no heat. This chart is an example based on a selected heating tower capacity and SCV bath temperature of 55°. These values will vary in other systems.

Turning next to FIGS. 5A and 5B, a table is provided that illustrates a number of variables in an example operating system. Ambient temperatures referred to in FIGS. 5 and 6 are wet bulb ambient air temperatures. In this system, it is desired to keep the SCV water bath at 55° in order to achieve the desired output gas temperature. The column in the left contains ambient wet bulb temperature values. It will be seen in this example that between 85° ambient temperature and 69° ambient temperature, the heating tower is able to add all of the required heat, and the fans are modulated so that the heating tower supplies the correct amount of heat.

Between 68° and 66° ambient temperature, the heating tower is no longer able to supply 100% of the required heat, and so the SCV is turned on. In this transition range the SCV is operating at its minimum turndown rate. Thus, it would be desirable in theory to modulate the heating tower so that the SCV does not provide excess heat beyond what is needed. However, if the time period spent in the ambient conditions in the transition range is relatively short, in other examples it may be desirable to simply turn the SCV on at its minimum turndown rate and allow some extra heat to be added by the combination of the SCV at minimum turndown and the tower at its full rate.

Next, at an ambient temperature between 65° and 55°, the heating tower is fully operational but as the ambient temperature decreases, the heating tower is providing gradually less heat. The SCV is modulated to gradually supply more heat to accommodate this decrease, so that the bath is maintained at a 55° supply temperature. When the ambient temperature falls below the desired bath temperature of 55°, the pump to the heating tower is shut off as well as the fans for the heating tower, in order to avoid the heating tower performing undesirable cooling. The SCV can be designed so that it has sufficient heat addition to add all the necessary heat by itself.

FIGS. 6A, 6B and 6C form a chart similar to that of FIGS. 5A and 5B, but where a superheater has been added to the SCV. The superheater adds heat so that the gas output temperature can be raised greater while having a cooler SCV water bath temperature. Accordingly, in this example the water bath temperature is set at 35°, which will also be the temperature of water return to the heating tower, as opposed to the 55° that was used in the example of FIGS. 5A and 5B.

In the wet bulb ambient temperature range of 85° to 69°, this chart is the same as FIGS. 5A and 5B. Between 68° and 52°, the tower can be operated at 100%. Instead of operating the SCV burners, the superheater can be started to maintain a gas send-out temperature to 40° F. A transition range exists in this example between 51° and 49°, where the SCV needs to be turned on because the superheater and tower together are not providing enough heat.

Between an ambient wet bulb temperature of 48° and 39° in this example, the heating tower is operated at 100%, the superheater is operating at full capacity, and the SCV is modulated to maintain a 35° water bath temperature which is also a 35° water supply temperature to the tower. At approximately 38°, the pump to the heating tower is shut off and all heat comes from the superheater combined with the SCV. Although there is still a small difference between the wet bulb temperature of 38° and the water bath heating tower supply temperature of 35°, at these temperatures, the heating tower is not very efficient and the heat added may not be worth the cost of running the heating tower pump and fans.

In this example, moreover, the water bath temperature which is the supply temperature is allowed to fluctuate in a range between 55° and 35° as a minimum, with 35° selected as a cutoff temperature just high enough so icing will not occur. Also in this condition where the heating tower is shut off, it may in some instances be desirable to operate the SCV to raise the bath temperature up to 55° at which the superheater may not be required. This will depend on the balance of efficiency between the superheater and the SCV.

Similarly, during the transition phase between 51° and 49°, as well as during the phases below the wet bulb temperature of 48°, depending on the design and capacity of the SCV, it would be possible to operate the SCV only without the superheater.

The system described above is an example control system which modulates the operation of a heating tower and/or an SCV by controlling parameters of one or both devices in response to the operating condition of the system. This system can provide significant benefits compared to the simple use of either an SCV or a heating tower by itself. For example, depending on the environmental conditions, the system can allow an installation to temperature over a wide range of ambient temperatures, while reducing fuel and/or electricity costs compared to a system lacking these controls.

The control method outlined in FIGS. 3 and 4 can be performed automatically, semi-automatically, or manually. In a preferred embodiment, a general purpose computer is programmed with software to perform some or all of the control steps. Alternatively, a programmed circuit board, or combination of circuit boards, may be used. Operations may be carried out via servo devices where appropriate. The system can be configured to run completely automatically without an operator. However, in other embodiments, the system may provide outputs to an operator who can then visually monitor the parameters of the system and its operation to confirm the desirable operation is occurring. In other embodiments, the system can be programmed to simply give indications to an operator of the current system performance, and the operator can manually make some or all of the input adjustments to the vaporization system.

FIGS. 7 and 8 are provided to depict information related to a heating tower performance curve. Various parameters of a heating tower can be determined by the heating tower manufacturer through design simulation or through actual testing. These parameters will enable a model to be constructed that permits the estimation of the heating tower's heat addition capacity at a given ambient wet bulb temperature. This model can be provided as a mathematical software program that will interface with the control system to provide this information as it is needed by the control system.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of vaporizing liquefied natural gas, comprising the steps of:

passing liquefied natural gas through a vaporization coil internal to a submerged combustion vaporizer, the submerged combustion vaporizer having an internal water bath at a bath temperature surrounding the vaporization coil and a burner that conveys hot flue gases directly into the internal water bath when operated, to provide a vaporized gas output at a send-out temperature;

drawing water from the internal bath of the submerged combustion vaporizer and supplying it to an atmospheric heating tower having an ambient air temperature;

returning water from the atmospheric heating tower to the internal bath of the submerged combustion vaporizer;

receiving control inputs at a control wherein said inputs comprise a gas send out rate control, a submerged combustion vaporizer heat rate control, a heating tower fan speed control and a heating tower water on/off control;

modulating the operating rate of the burner of the submerged combustion vaporizer by measuring and performing feedback on the measured gas send-out temperature; and modulating the operating rate of the atmospheric heating tower by manipulating the fan control and the tower on/off control in response to the control inputs by measuring and performing feedback on the measured gas send-out temperature.

2. The method according to claim 1, wherein at least one of the operating rate of the burner of the submerged combustion vaporizer and the operating rate of the atmospheric heating tower are modulated based on the ambient air temperature.

3. The method according to claim 2, wherein the ambient air temperature used for modulation is one of a calculated ambient air wet bulb temperature or a sensed ambient air wet bulb temperature.

4. The method according to claim 1, further comprising the steps of:

determining whether the heating tower can supply a desired heat rate to the bath; and turning off the burner of the submerged combustion vaporizer when it is determined that the heating tower can supply the desired heat.

5. The method according to claim 4, wherein the determining step is based on the ambient air temperature.

6. The method according to claim 5, wherein the ambient air temperature used for modulation is one of a calculated ambient air wet bulb temperature or a sensed ambient air wet bulb temperature.

7. The method according to claim 4, wherein the determining step is based on the gas send-out temperature.

8. The method according to claim 1, further comprising the steps of:

determining whether the submerged combustion vaporizer can supply a desired heat rate to the bath; and turning off the heating tower when it is determined that the submerged combustion vaporizer can supply the desired heat.

9. The method according to claim 8, wherein the determining step is based on the ambient air temperature.

10. The method according to claim 9, wherein the ambient air temperature used for modulation is one of a calculated ambient air wet bulb temperature or a sensed ambient air wet bulb temperature.

11. The method according to claim 8, wherein the determining step is based on the gas send-out temperature.

12. The method according to claim 1, further comprising the steps of:

determining an available heat output from the heating tower based on the ambient temperature; and modulating the operating rate of the submerged combustion vaporizer based on the determined amount of heat available from the heating tower.

13. The method according to claim 12, wherein the determining step is based on the ambient air temperature.

14. The method according to claim 13, wherein the ambient air temperature used for modulation is one of a calculated ambient air wet bulb temperature or a sensed ambient air wet bulb temperature.

15. The method according to claim 12, wherein the determining step is based on the gas send-out temperature.

16. The method according to claim 1, further comprising the step of superheating the natural gas output after it passes through the submerged combustion vaporizer to raise the temperature of the gas.

17. An apparatus for vaporizing liquefied natural gas, comprising:

a submerged combustion vaporizer having an internal water bath at a bath temperature surrounding a vaporization coil and a burner that conveys hot flue gases directly into the internal water bath when operated, to provide a vaporized gas output from the vaporization coil at a send-out temperature;

an atmospheric heating tower having an ambient air temperature;

a circuit that draws water from the internal bath of the submerged combustion vaporizer and supplies it to the atmospheric heating tower and returns the water from the atmospheric heating tower to the internal bath of the submerged combustion vaporizer; and a controller that modulates the operating rate of the burner of the submerged combustion vaporizer, and the operating rate of the atmospheric heating tower, wherein said controller receives control inputs that comprise a gas send out rate control, a submerged combustion vaporizer heat rate control, a heating tower fan speed control and a heating tower water on/off control that dictate the modulating of the vaporizer and the heating tower.

18. The apparatus according to claim 17, wherein at least one of the operating rate of the burner and the operating rate of the atmospheric heating tower are modulated based on the ambient air temperature.

19. The apparatus according to claim 18, wherein the ambient temperature used for modulation is one of a calculated ambient air wet bulb temperature or a sensed ambient air wet bulb temperature.

20. The apparatus according to claim 17, wherein at least one of the operating rate of the tower and the operating rate of the atmospheric heating tower are modulated based on the gas send-out temperature.

* * * * *